United States Patent [19]

Mixon, Jr.

[11] Patent Number: 4,813,894

[45] Date of Patent: Mar. 21, 1989

[54] ELECTRICAL CONNECTOR

[75] Inventor: James L. Mixon, Jr., Harrisburg, Pa.

[73] Assignee: AMP Incorporated, Harrisburg, Pa.

[21] Appl. No.: 124,703

[22] Filed: Nov. 24, 1987

[51] Int. Cl.[4] ..... H01R 11/01

[52] U.S. Cl. ..... 439/783; 439/807

[58] Field of Search ..... 439/783, 784, 803, 805, 439/807, 815

[56] References Cited

U.S. PATENT DOCUMENTS

| | | | |
|---|---|---|---|
| 2,106,724 | 3/1935 | Cope | 439/783 |
| 3,349,167 | 10/1964 | Mixon, Jr. et al. | 439/783 |
| 4,027,939 | 6/1977 | White | 439/807 |
| 4,600,264 | 7/1986 | Counsel | 439/783 |

OTHER PUBLICATIONS

SWC-label, "SWC Wire Connectors"-No. 12, Wire Printed Publication Label Shows Electrical Connector.

*Primary Examiner*—Paula A. Austin Bradley
*Attorney, Agent, or Firm*—Allan B. Osborne

[57] ABSTRACT

An electrical connector for mechanically securing and electrically interconnecting a pair of electrical cables. More particularly, the connector includes a C-member defining cable-receiving channels and having an arcuate portion in the web section extending between the channels to define an interior space in communication with an offset from the channels. Also included is a tapered drive member which is advanced into the space to engage the cables positioned in the channels to secure and electrically interconnect them.

5 Claims, 3 Drawing Sheets

ELECTRICAL CONNECTOR

FIELD OF THE INVENTION

This invention relates to electrical connectors used to mechanically and electrically interconnect overhead electrical transmission and distribution cables. More particularly, it is concerned with connectors of the type having a C-shaped member and a complementary wedge member which is driven into the former to mechanically grip and electrically interconnect two cables positioned therein.

BACKGROUND OF THE INVENTION

Electrical connectors of the type having a C-member with converging channels and a complementary wedge member to mechanically grip and electrically interconnect two electrical cables are well known in the art. The cables are gripped and interconnected electrically by driving the wedge member into the C-member to wedge the cables tightly in the channels.

Three methods of driving the wedge member into the C-member have been disclosed. One method, disclosed in U.S. Pat. Nos. 1,801,277 and 4,600,264 uses a bolt threadedly attached to the C-member to drive the wedge. A second method, disclosed in U.S. Pat. No. 3,212,534 uses a tool having an explosively driven ram for driving the wedge. In the third method, disclosed in U.S. Pat. Nos. 3,257,499 and 3,304,962, an explosive charge in the wedge member cooperates with a stationary member to drive the wedge member into the C-member.

It is now proposed to mechanically grip and electrically interconnect a pair of electrical cables by advancing a tapered drive member in between the cables and the arcuate portion of the connecting web portion of the C-shaped member.

SUMMARY OF THE INVENTION

According to the invention, an electrical connector is provided which includes a C-member having cable receiving channels along each side connected by an arcuate web portion in the web section extending between the channels to define an offset space relative thereto and a tapered drive member having threads or ribs extending around the circumference thereof. The drive member is advanced into the space in the C-member to engage cables positioned in the channels to mechanically secure and electrically interconnect them.

DESCRIPTION OF THE INVENTION

Figure 1:
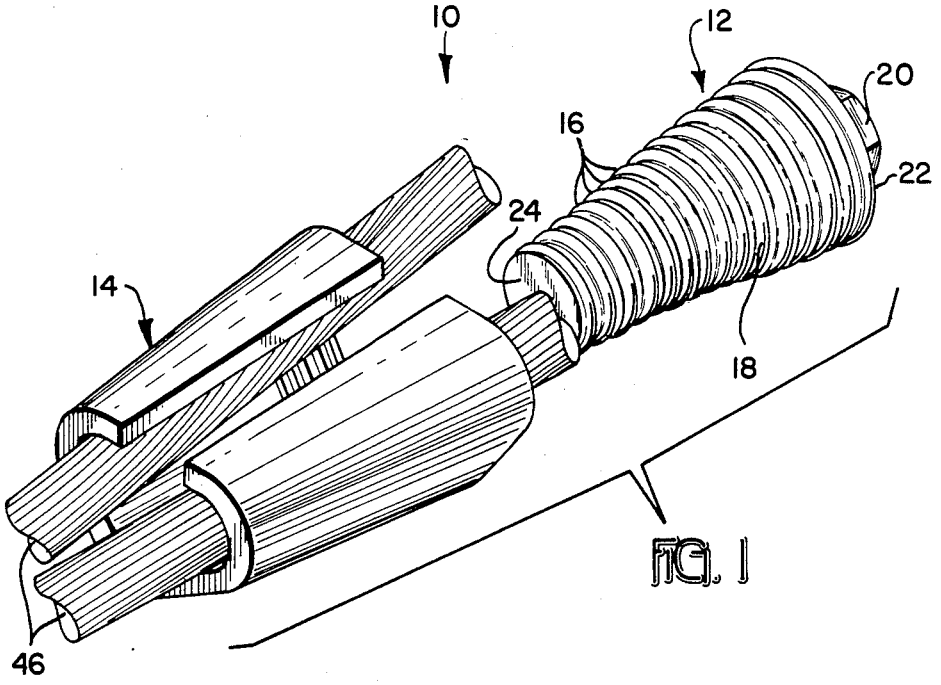
FIG. 1 is a perspective view of the electrical connector of the present invention with cables positioned in the C-member.

As shown in FIG. 1, electrical connector 10 of the present invention includes drive member 12 and C-member 14. Drive member 12 is tapered and includes a number of ribs 16 encircling cable engaging portion 18. Ribs 16 can be discrete as shown or a continuous, helical thread. Hexagonal head 20 is provided at rear end 22 to provide means for turning drive member 12 with a tool (not shown) e.g., a wrench. Leading end 24 is shown as being flat thereacross, although it could be rounded.

C-member 14, as shown more clearly in FIGS. 3*a*, 3*b*, 4*a* and 4*b*, includes an elongated body 26 in the general shape of a C and is wedge shaped longitudinally with end 28 being wider than opposing end 30. Lateral sides 32 have been rolled over to face each other to define a pair of spaced apart cable channels 34 within body 26. Web section 36 which extends between respective channels 34 includes arcuate portion 38 with the concave surface 40 thereof giving form to interior space 42. As can be seen in the drawings, space 42 communicates with and is generally off-set from channels 34. In keeping with the wedge shape, space 42 decreases in volume towards end 30.

Both drive member 12 and C-member 14 may be made from aluminum such as 6061. In the case of drive member 12 the aluminum is 6061T-6.

Figure 2:
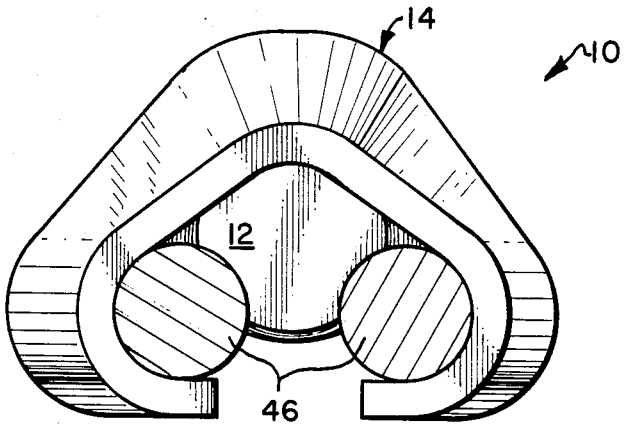
FIG. 2 is an end view of the connector of FIG. 1.
Figure 3A:
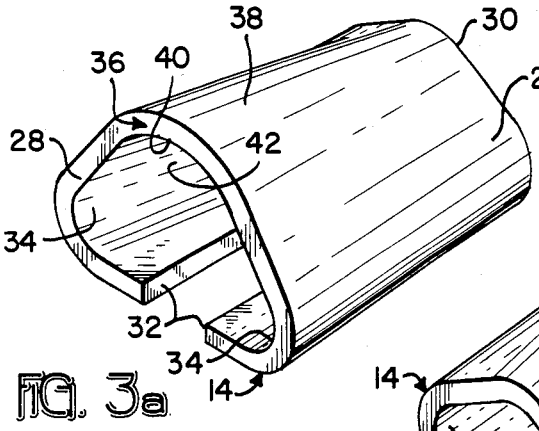
FIGS. 3*a* and 3*b* are perspective views of the C-member taken from respective ends.
Figure 3B:
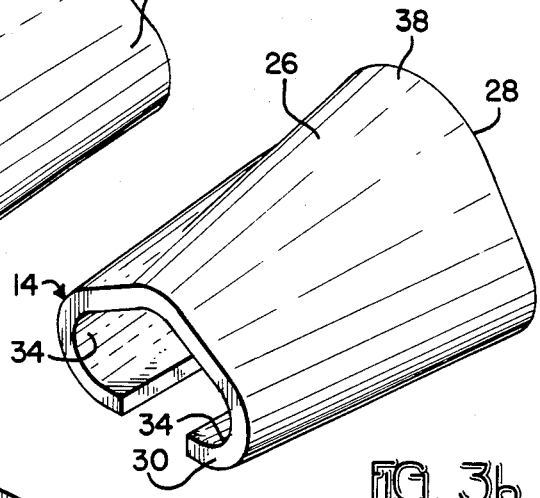
Figure 4A:
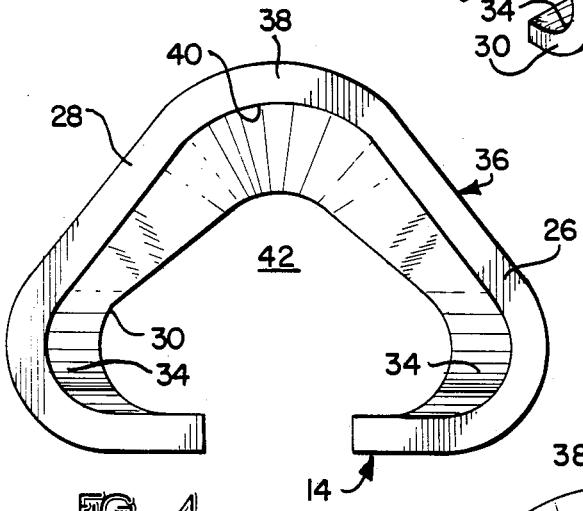
FIGS. 4*a* and 4*b* are views looking into respective ends of the C-member.
Figure 4B:
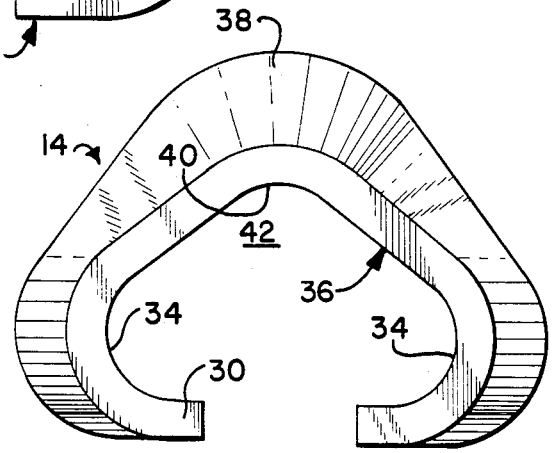
Figure 6:
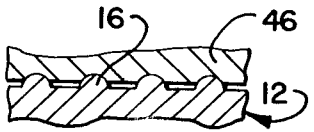
FIG. 6 is a segmented, sectioned view showing the ribs on the drive member engaging a cable.
Figure 5:
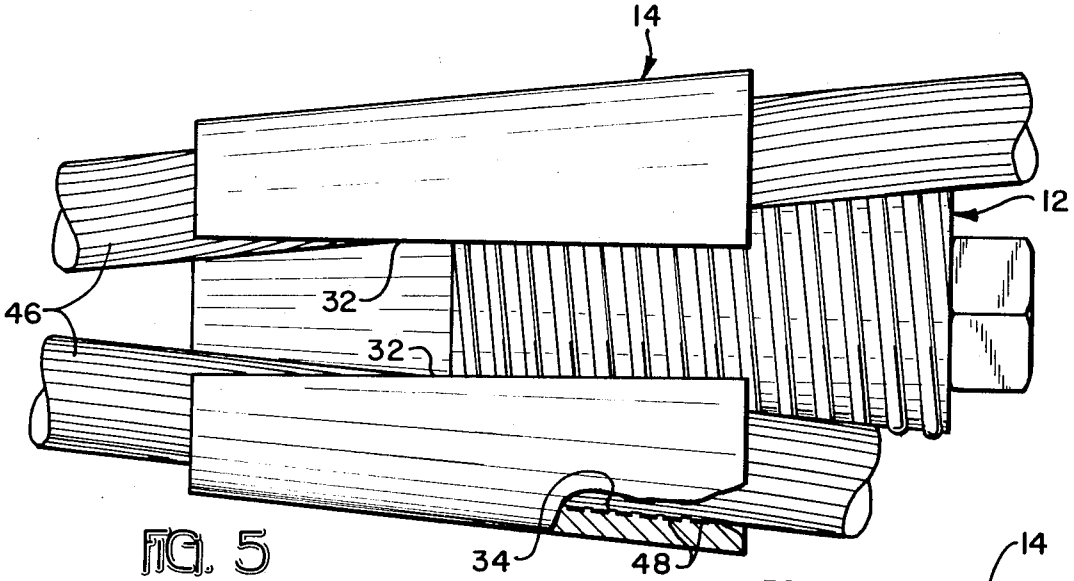
FIG. 5 is a plane view of the electrical connector with a pair of cables secured therein.

In operation, cables 46 are positioned in respective channel 34 as shown in FIGS. 1 and 2. Drive member 12 is then rotatably advanced into space 42, compressing cables 46 into respective channels 34 as shown in FIG. 5. Concurrently, edges 32 of body 26 may be resiliently spread apart, thereby storing compressive energy which can be utilized in maintaining cables 46 in compression during thermal-induced shrinkage. In FIG. 5, body 26 has been broken away to expose a portion of a channel 34 which has been modified by the inclusion of a number of serrations 48 which provide an irregular surface capable of breaking up oxides on cables 46. In this respect, FIG. 6 is an enlarged view showing ribs 16 on drive member 12 indenting a cable 46 to provide a cleaner electrical contact as well as to increase the mechanical grip therebetween.

Figure 7:
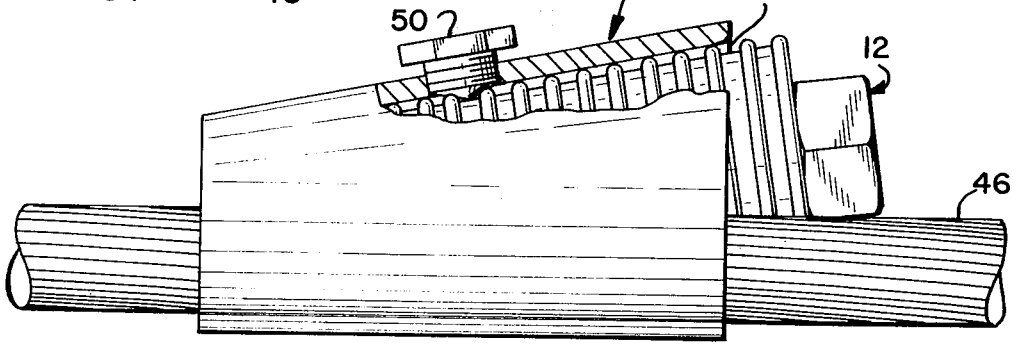
FIG. 7 is a side view of the electrical connector.

FIG. 7 is a side view of connector 10 with cables 46 secured therein. This view illustrates the location of drive member 12 in space 42 provided by arcuate portion 38 and the off-center engagement with cables 46. Also shown is the addition of screw 50 threadedly mounted in web portion 36. After advancing drive member 12 into C-member 14, screw 50 is turned down to prevent any movement thereof. In the event ribs 16 is a helical thread, screw 50 can also provide a thread cleaning and following function.

As can be discerned, an electrical connector for mechanically securing and electrically interconnecting electrical cable has been disclosed. The connector includes a tapered drive member having circumferential ribs thereon and a wedge-shaped C-member having an arcuate portion in the web section extending between the interior, cable-receiving channels. The concave surface of the arcuate portion defines a space which is in communication with and offset from the channels. With cables in the channels, the tapered drive member is rotatably driven into the space, engaging the cables to secure them in the channels and electrically interconnect them.

I claim:

1. An electrical connector for interconnecting a pair of electrical cables, comprising;

a longitudinally wedge-shaped body member being generally C-shaped in cross-section to define a pair of spaced-apart, longitudinally extending channels and having a web section extending between said channels, said web section including a longitudinally extending arcuate portion with a concave surface thereof defining a space within said body member which communicates with and is offset from said channels and which further narrows from one end towards another end of said body member;

a tapered drive member having discrete circumferential ribs thereon and being adapted to be driven into said space in said body member to engage cables which may be positioned in said channels and to compress, secure and electrically interconnect them; and a screw threadedly received in said web section of said body member for being advanced between said discrete ribs on said tapered drive member to prevent movement thereof.

2. The electrical connector of claim 1 wherein said tapered drive member includes a hexagonal bolt head at one end so that said tapered drive member may be driven into said space in said body member by a wrench.

3. The electrical connector of claim 1 wherein the channels of said body member are provided with serrations.

4. The electrical connector of claim 1 wherein said rib means on said tapered drive member is a helical thread.

5. The electrical connector of claim 4 further including a screw threadedly received in said body member and adapted to engage said helical thread to provide a thread cleaning and following function.

* * * * *